United States Patent [19]

Van Brunt et al.

[11] Patent Number: 4,820,201

[45] Date of Patent: Apr. 11, 1989

[54] CABLE SHIELD TERMINATION FOR AN ELECTRICAL CONNECTOR

[75] Inventors: Michael K. Van Brunt, Ventura; Robert J. Nicoletti, Camarillo, both of Calif.

[73] Assignee: G & H Technology, Inc., Santa Monica, Calif.

[21] Appl. No.: 88,410

[22] Filed: Aug. 24, 1987

[51] Int. Cl.[4] ..... H01R 13/648

[52] U.S. Cl. ..... 439/610

[58] Field of Search ..... 439/607–610, 439/95, 96, 98, 108

[56] References Cited

U.S. PATENT DOCUMENTS

| | | | |
|---|---|---|---|
| 3,663,929 | 5/1972 | Miertschin et al. | 439/608 |
| 4,382,653 | 5/1983 | Blanchard | 439/610 |
| 4,447,100 | 5/1984 | Dyce et al. | 439/607 |
| 4,598,969 | 7/1986 | Stephenson | 439/608 |
| 4,679,013 | 7/1987 | Farrar et al. | 439/607 |

*Primary Examiner*—John McQuade
*Attorney, Agent, or Firm*—George J. Netter

[57] ABSTRACT

A grounding plate having a flanged edge wall continuously around its periphery is press fit into the open end of a connector part shell. The plate provides a continuous intimate contacting relationship between the plate flange and the inner wall of the connector shell. A plurality of openings are formed in the plate aligned with the connector contacts contained within the connector part. A length of shielding braid, which can be identical to that carried by a cable wire has one open end soldered onto a cable wire shield. A metal ferrule grounding plug has an open end which is soldered or otherwise electrically and mechanially secured to the other end of length of shield braid. The outer end of the grounding plug has a radially outwardly directed flange and a slotted side wall, such that the plug on being inserted into a grounding plate opening is compressed, and then when the flange has passed through the plate it snaps outwardly to lock the plug in place. An alternative form includes a removable grounding plate held within the connector part end by an end cap or connector shell extender.

11 Claims, 4 Drawing Sheets

CABLE SHIELD TERMINATION FOR AN ELECTRICAL CONNECTOR

The present invention relates generally to the shielding of electrical connectors and, more particularly, to the shield termination of a cable which is interconnected to a separable electrical connector.

BACKGROUND OF THE INVENTION

An electro-mechanical connector of the kind with which we are particularly concerned here, includes plug and mating receptacle parts which can be releasably joined to interconnect through internally located contacts, a set of cables or harness wires brought to each of the connector parts. Such electrical connectors have a wide use in providing releasable connections for electrical and electronic equipment of great variety.

Such equipment, especially electronics equipment, is especially susceptible to disturbance and even damage from external interference electromagnetic fields. The external electromagnetic interference can be of a relatively low level which induces noise into electronic circuits and cabling, and is detrimental to operational efficiency and accuracy. Still higher levels of interference fields such as radar, for example, can result in substantial disruption of operation of electronics equipment if precautions are not taken. For very high levels of interference, such as that which can occur at a substantial distance from a nuclear occurrence for example, and which can induce currents in the range of hundreds or perhaps thousands of amperes, sensitive, unshielded electronic equipment can be completely damaged or destroyed. Higher level interference of this latter kind is frequently referred to as electromagnetic pulse or EMP interference.

Cabling to electrical and electronic equipment that it is desired to protect against external interference fields is typically enclosed within a metal braid or other conductive shield extending from an equipment termination point and to termination at a releasable connector. It is this termination at a connector with which we are particularly concerned here.

At the present time, termination of a cable shield to an electrical connector is conventionally accomplished by the use of jumpers, pigtails or daisy chains which conductively interconnect the cable shield at a point closely adjacent to the connector and the connector shell. Despite their wide present use, they do not provide fully satisfactory termination in that substantial "windows" are available for the polluting fields to make their way to the cable wires or to internal parts of the electrical connector.

There are other situations in which there is a similar need for termination of shielded cable wires. For example, there is a class of terminal junction blocks which consist generally of a metal housing enclosing contacts each which is accessible through an opening in a wall of the housing. Shielded cable wires having complementary contacts on their ends are each inserted through the junction block housing opening and mated with an enclosed contact. Termination of the cable wire shield has in the past been accomplished as discussed above in connection with electromechanical connectors.

SUMMARY OF THE DISCLOSURE

It is therefore a primary aim and object to provide an improved termination system for a shielded cable wire to a connector part of a releasable electrical connector.

A further object is the provision of a cable shield termination at an electrical connector shell which substantially eliminates any available window for external electromagnetic field interference.

A releasable electrical connector of the kind with which we are specifically concerned here has plug and receptacle parts, each including a substantially cylindrical electrically conductive shell within which are mounted insulative inserts carrying metal contacts, either pin or socket variety. In conventional use the electrical parts are coupled together causing the contacts within the mating connector part to mate and effect electrical connection between cable wires connected to the respective contacts. Shielding for the cable wires typically consists of wire braid which has been affixed in the past at one or more points to the connector shell by a jumper, pigtail, or so-called daisy chain.

In a first embodiment of the disclosure, a grounding plate having an interlocking flanged edge wall continuously around its periphery is of such dimensions as to enable it to permanently mount to the open end of a connector part, either plug or receptacle. In this way, the plate provides a continuous intimate electrical and mechanical contacting relationship between the plate flange and the inner wall of the connector shell. A plurality of openings are formed in the plate surface in alignment with the connector contacts contained within the connector part insulative insert.

A short length of shielding braid, which can be identical to that carried by a cable wire, has one end open and a grounding plug attached to the other end. More particularly, the grounding plug is a metal ferrule with an open end which is electrically and mechanically secured to the short length of shield braid. The outer end of the grounding plug has a radially outwardly directed flange and slotted side walls, such that the plug on being inserted into a grounding plate opening is compressed, and then when the flange has passed through the plate it snaps outwardly to press fit the plug in place.

In use, the cable wire braid is dressed back leaving a length of insulated cable. The section of shield braid with a grounding plug is placed on the insulated cable and the facing braid portions are electrically and mechanically secured together. The insulation is removed from the cable wire end which is then secured to a socket or pin contact. The socket or pin contacts are pushed through a shielding ground plate opening and securely positioned within a connector insulative insert. The grounding plug is now snapped in place within the shielding plate opening.

The following alternate form of the invention is particularly adaptable for use in retrofitting and converting an existing electrical connector of the same general type described in connection with the first embodiment to achieve the same superior cable shield termination. In this case, an adapter grounding plate of general construction substantially identical to that of the first embodiment is provided, only having an outer diameter slightly greater than the inner diameter of the connector shell within which it is to be mounted. The plate includes a plurality of openings which, when assembled to the connector part, are respectively in alignment with contact arrangements of the connector part.

In assembly of this further embodiment, the adapter ground plate is inserted into the open end of the connector part with its flange received within the connector part shell. An adapter nut is threaded onto the connector part which has portions that engage the outer edge margins of the shielding or grounding plate forcing it inwardly and a secure mounting and contacting relationship with the connector shell. Cable wires are connected via plugs of the same kind as used in the first described embodiment.

DESCRIPTION OF PREFERRED EMBODIMENTS

Figure 1:
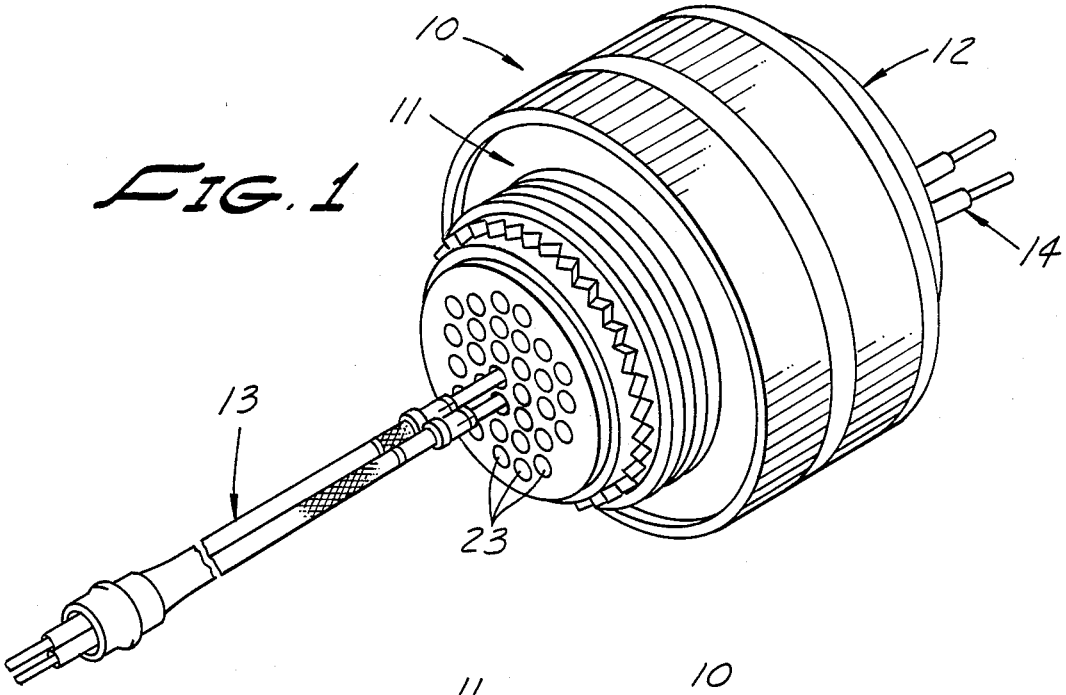
FIG. 1 is a perspective view of an electrical connector with a grounding plate of the present invention shown.
Figure 2:
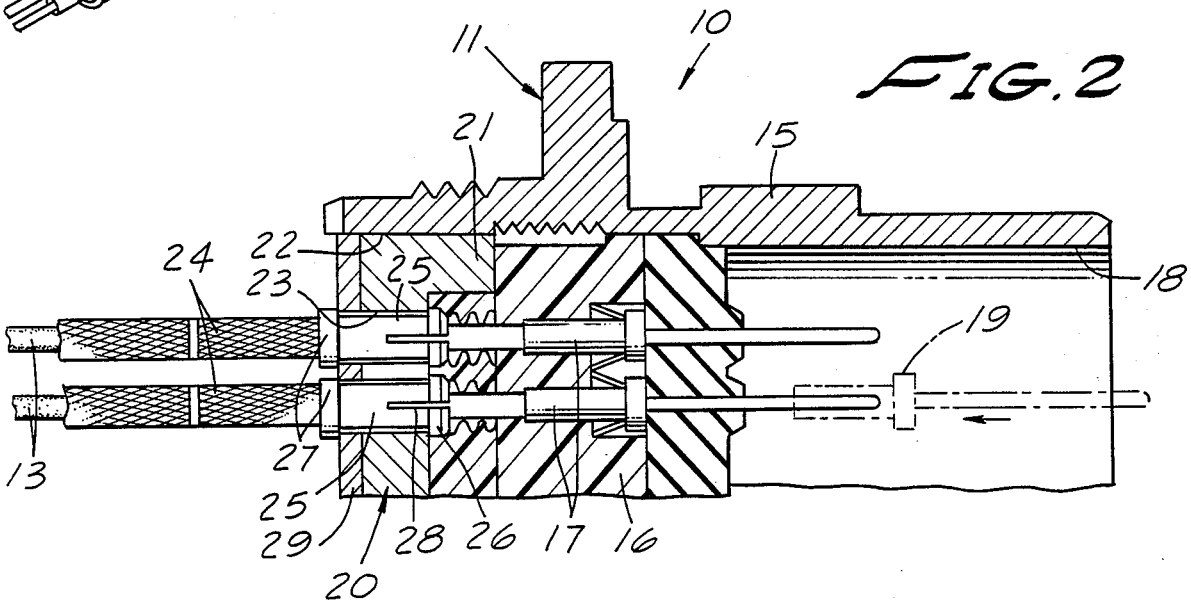
FIG. 2 is a side elevational, sectional view of the connector of FIG. 1.
Figure 3:
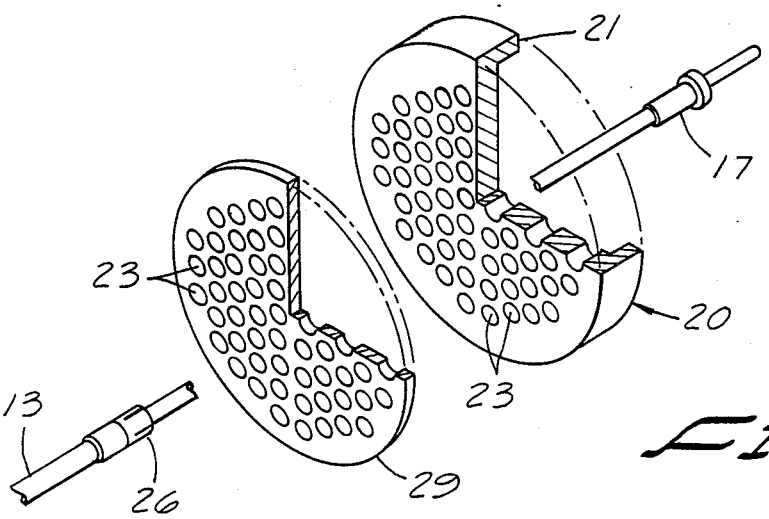
FIG. 3 is a perspective view, partially schematic, of a shielding plate of the invention with an environmental seal.

Turning now to the drawing, and particularly FIGS. 1 and 2, an electrical connector of the kind with which the present invention is especially advantageous is enumerated generally as 10. The connector includes in its major parts a receptacle connector part 11 which, on mating ith a plug connector part 12, establishes electrical connection between a set of cable wires 13 and 14 in a well-known way. Each of the connector parts includes an outer metallic shell within which the various connector components are arranged.

Turning now specifically to FIG. 2, the connector receptacle part 11 is seen to include a generally open-ended cylindrical metal shell 15 within which rubber (or plastic) insulative inserts 16 are provided having longitudinally directed openings for receiving pin contacts 17 therein. The plug connector part 12 also includes an outer metal shell similar to the receptacle shell 15 differing primarily in being dimensioned for receipt within the open end 18 of the receptacle connector. Also, the plug carries a set of socket contacts 19 having parts which coact with the pin contacts 17 to establish electrical connection to the cable wires 14.

As is well known to those skilled in the connector art, one end of both the pin and socket contacts 17 and 19 is open for receiving a cable wire 13, 14, respectively, therein, and to which it is electrically connected by either crimping, soldering, or other means, as desired.

A shielding or grounding plate 20 is a generally metal cylindrical disk having at its peripheral edge a continuous flange 21 extending at right angles to the disk. The outer diameter of the shielding plate is such that it can be press fit within the other open end 22 of the receptacle shell forming a 360 degree mechanical and electrical interconnection with the shell wall. Alternatively, the shielding or grounding plate 20 can be secured to the connector shell by threading, welding, use of clamping means, or bonding by a conductive epoxy. Thus, as shown in FIG. 2, when the shielding plate 20 is forced into the end of the shell 15, the outer edge surface of the plate and flange 21 are in continuous intimate contact with the receptacle inner surface. Also, as can be seen best in FIG. 2, the inner edge of the shielding plate flange 21 is only very slightly spaced from the innermost ends of the contacts 17.

The circular surface of the plate 20 includes a plurality of openings 23 formed therein and so located as to align individually with the contacts 17 located within the receptacle shell insert. The width dimension of these openings must be such as to enable insertion of a contact through the opening for placement within the connector part insulative insert.

Initial preparation of a cable wire 13 or 14 for purposes of the invention consists of removing an end portion of the cable braid shield (e.g., 10 inches) leaving a length of insulated cable wire without braid shield extending outwardly of the braid shield.

A separate length of braid shield 24 which can be the same as or substantially the same as that used on the cable is provided with a grounding plug 25 electrically and mechanically secured in place. This grounding plug is a metal ferrule, one end of which has a sufficient diameter for receiving a shield braid end portion and which are similarly secured together. The opposite end of the grounding plug terminates in an enlarged first flange 26 and includes a second flange 27 spaced therefrom leaving a smaller diameter portion between the flanges which is dimensioned to fit snugly within a grounding plate opening 23. The grounding plug side wall is longitudinally slotted at 28 allowing the plug to be transversely compressed for a purpose to be described.

The separate length of shield braid 24 with attached grounding plug is then slid onto the unshielded cable wire and the two matching end portions of the shield braid are electrically and mechanically secured together with a short length of unshielded cable wire extending from the grounding plug.

Next, the insulation is stripped from the cable wire end and the bare wire is terminated within the open end of a pin contact 17 or 19. By the use of a conventional tool, the pin contact and connected wire are inserted through an opening 23 in a rubber or plastic interface seal or gasket 29 and the shielding plate 20 for positive location within the connector part insulative insert. Finally, the grounding plug is passed through an opening in the interface seal and snapped into place within the appropriate opening 23 of the shielding plate (FIG. 2).

When so assembled the cable braid is terminated through the grounding plug to the shield plate, and, thus, to the connector part shell. Any interference signals induced into the cable shield are terminated at the connector part shell. Moreover, when the connector plug and receptacle are mated the cable wires and connector contacts are surrounded by the shield braid and the connector shells, and in that way shielding against electromagnetic pollution from external interference fields.

Figure 4:
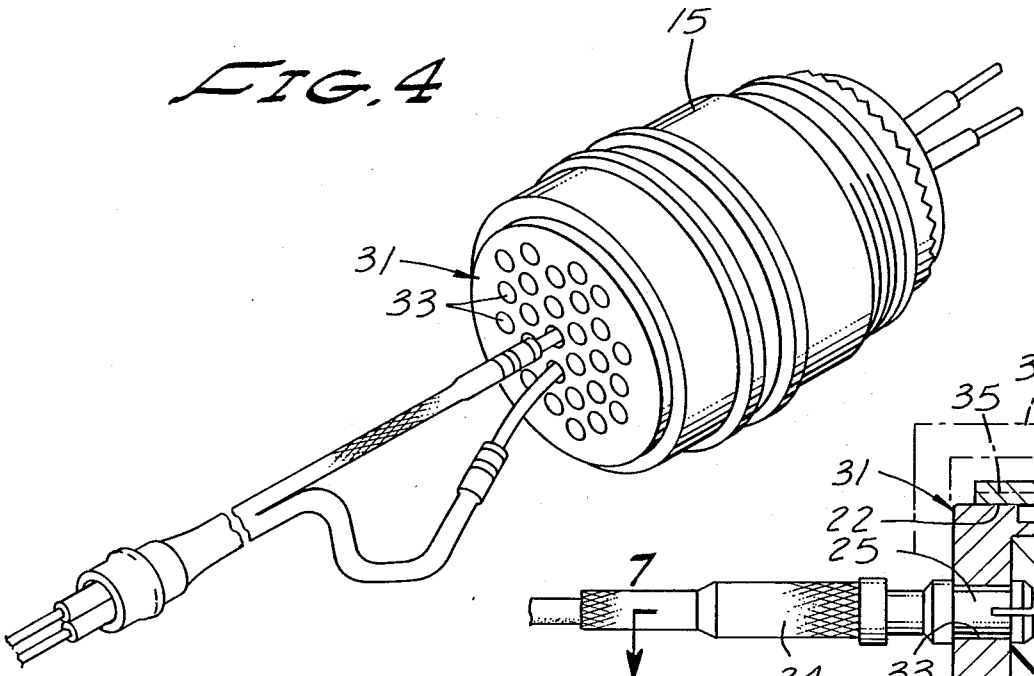
FIG. 4 is a perspective view of an alternative embodiment showing the adapter connector to an already existing cable system.
Figure 7:
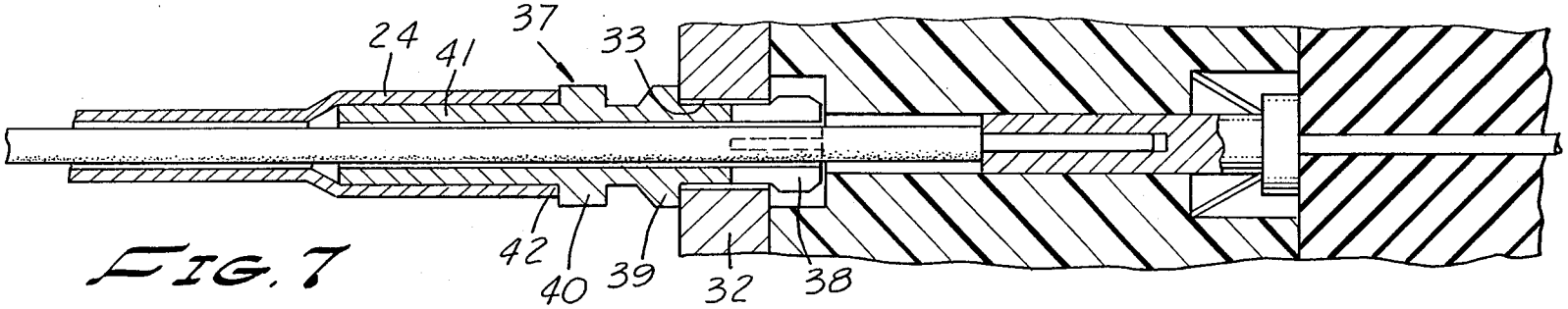
FIG. 7 is an enlarged, side elevational, sectional view taken through the grounding plug and a portion of the connector.

For the ensuing description of an alternate embodiment of the invention especially advantageous in adapting to an already existing connector, reference is made to FIGS. 4 and 7. The connector parts are assumed to be identical to those of the first described embodiment, and, accordingly, the same reference numerals for the same components are used.

Figure 5:
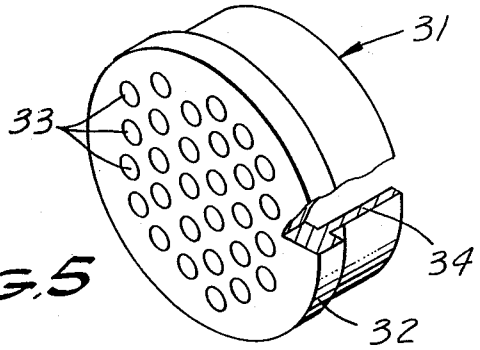
FIG. 5 is a perspective view of the shielding plate of this further version.
Figure 6:
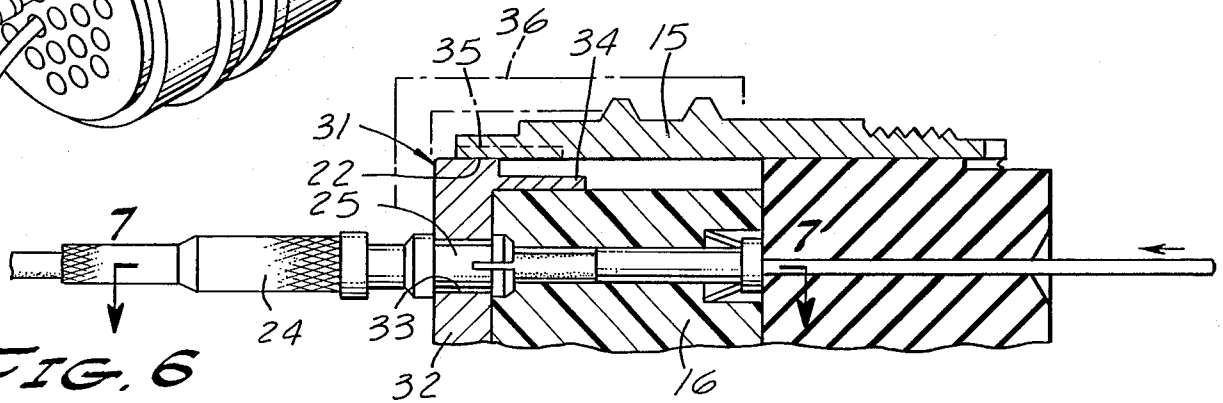
FIG. 6 is a side elevation, sectional view of the connector and shielding plate of the invention of FIG. 4.

An adapter shielding plate 31 includes a circular metal disk 32 having a diameter enabling snug receipt with the open end 22 of the receptacle shell 15. A plurality of openings 33 are formed in the disk of such a number and arrangement as to provide a one-for-one alignment with contacts mounted in inserts 16. An upstanding continuous wall or flange 34 extends away from the disk 32 at its periphery. More particularly, the outer diameter of the flange 34 is slightly less than that of the disk 32 and has an inner diameter permitting fitting receipt onto an insert 16 (FIG. 5).

In use, the shielding plate 31 is placed in the receptacle shell with correct alignment of openings 33 and insert openings being formed by an indexing keyway 35. An end cap 36 threaded onto the receptacle shell has portions securing the shielding plate 31 in good contacting relation within the receptacle shell. Optionally, an extender shell (not shown) may be attached onto the receptacle shell having internal parts which clamp against the shielding plate outer end for securement and to establish a conductive relation with the receptacle shell.

In this adapter version, grounding plugs 25 can be connected to the cable wire braid in the same way as in the first described embodiment, and, as well, the plugs are terminated at the shielding plate in the same way.

FIG. 7 shows an alternate form of grounding plug 37 for securement to either a separate length of shield braid 24 or directly to an end portion of the cable wire braid, itself. As shown, the plug is an elongated metal ferrule having a first enlarged flange 38 at the plug end, a second flange 39 spaced from the first flange, a third flange 40 and an elongated sleeve portion 41. The sleeve portion is dimensioned so as to be slidingly received over the insulated cable wire and under the shield braid. The grounding plug and shield braid are electrically and mechanically secured together at 42.

Figure 8:
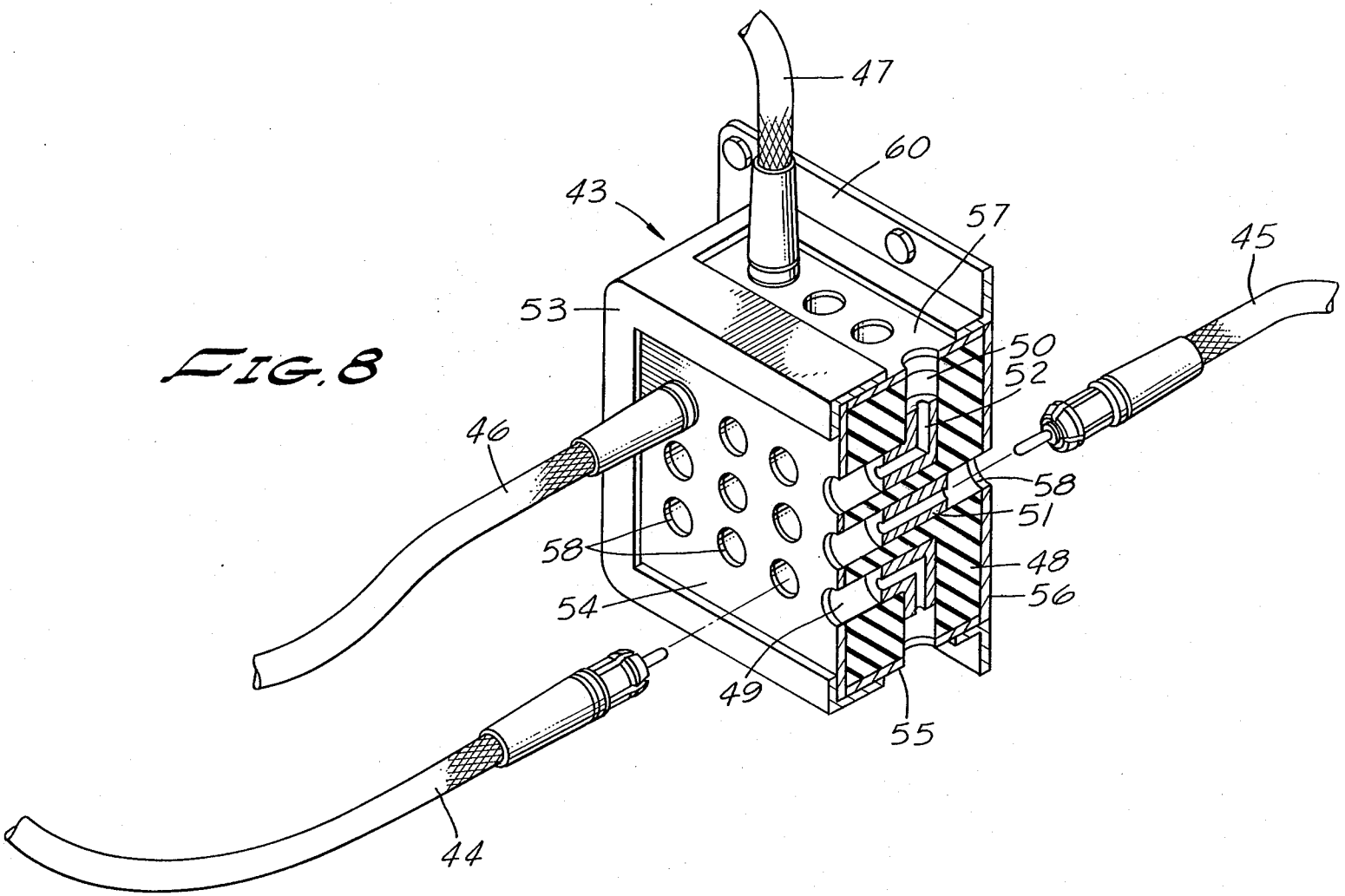
FIG. 8 is a perspective partially sectional view of a terminal junction box showing a grounding plate and means of this invention for terminating a cable shield.

Although in the previously described embodiment reference has been made to application of the invention to an electrical connector having cylindrical metal shell parts, the subject invention can be beneficially used with a connector or junction box of substantially any geometry. For example, FIG. 8 shows a junction box 43 via which pairs of shielded cable wires 44, 45 and 46, 47 can be mated together and the cable shields are terminated as will be described. The junction box includes an insulative core 48 shown as generally rectangular having one or more openings 49 extending straight through the core to open out on an opposite core face, and other L-shaped openings 50 with entrances on adjacent core faces. Female (optionally, male) contacts 51 and 52 are fit into the respective openings 49 and 50 for interfitting with complementary contacts introduced through the openings. Normally, the core 48 in such a junction box is carried within an open metal frame 53 for convenient mounting to a flange member 53', for example.

To modify in accordance with this invention, separate shielding or grounding plates 54–57 of respectively appropriate dimensions are located over each of the core flat surfaces and secured within the frame 53. The grounding plates have openings 58 formed therein aligned with the core openings.

The cable wires include grounding plugs at an end, which can be identical to plugs 28, that are mechanically and electrically secured to the cable wire shield. The grounding plugs also have a contact which can mate with a contact 51 or 52 on the grounding plug being located within an opening 58. The grounding plug securement to a grounding plate is the same as in the first described embodiment.

Figure 9:
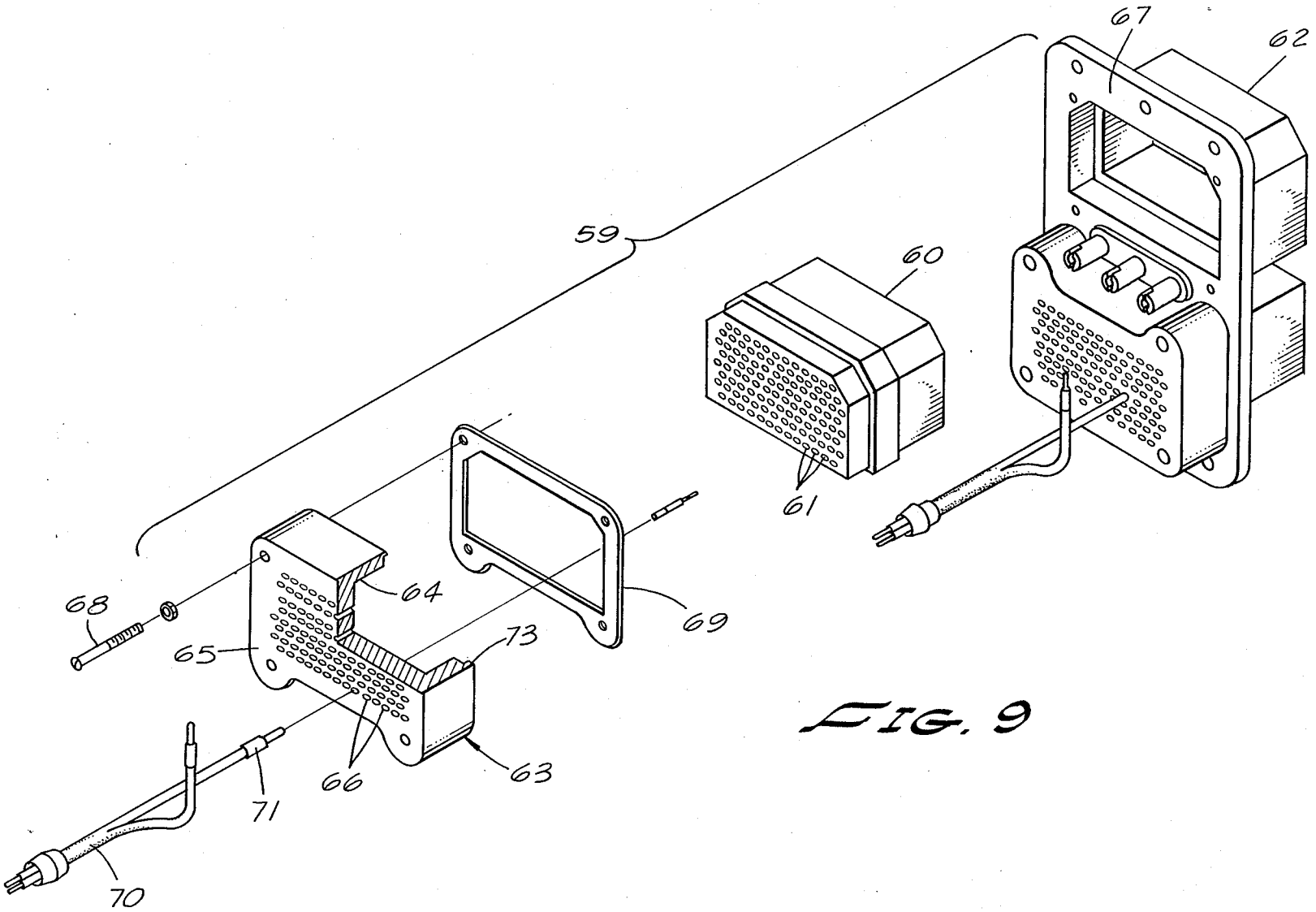
FIG. 9 is a perspective exploded view of a further embodiment of the invention for use with an ARINC series connector.

FIG. 9 shows a frequently encountered commercially available connector 59 referred to as an ARINC series connector. This connector includes an insulative body 60 within which contacts (not shown) are mounted each in alignment with an opening 61 in an outer wall surface. The insulative body with included contacts is mounted within a hollow metal housing 62, the body surface with openings 61 extending outwardly thereof. To convert this standard connector to the present invention a grounding shell 63 has a cavity 64 on one side which fittingly receives the insulative body 60 therewithin. An opposing wall 65 has openings 66 aligned with openings 61. The grounding shell 63 when mounted over the body 60 has a continuous edge which is held in intimate contact with a housing surface 67 by threaded members 68. An environmental and electromagnetic seal 69 fits around the cavity of 64 and the mating surface at 67. Cable wires 70 are provided with grounding plugs 71 which are secured within as in the first described embodiment.

The different shielding or grounding plates or shells have been described as preferably made of metal. However, it is to be understood that other materials such as conductive composites can also be advantageously employed for this purpose.

What is claimed is:

1. A cable shield termination system, comprising:

an electrical connector part having a metal shell with an open end via which the cable with an electrical contact on its end it introduced;

a metal disk received within the shell open end, said disk having edges which conductively engage an inner wall of the metal shell and an opening extending through the disk of sufficient dimensions to enable passage of the cable and electrical contact;

a hollow metal grounding plug of external dimensions permitting fitting and contacting receipt within the disk opening and an internal opening sufficient to allow the cable to pass therethrough said grounding plug having a slotted side wall, first and second radially extending flanges larger than the disk opening cross-section, and the spacing between the first and second flanges being approximately equal to the disk thickness; and a predetermined length of a hollow tubular metal shield with one end conductively secured within the grounding plug opening, the other end of said tubular metal shield being for receipt on the cable and for conductive securement to the cable shield.

2. A cable shield termination system as in claim 1, in which the metal disk is press fit within the shell open end.

3. A cable shield termination system as in claim 2, in which the metal disk includes a continuous flange arranged about the disk periphery.

4. A cable shield terminations system as in claim 1, in which the cable shield and the hollow tubular metal shield are constructed of a metallic braid.

5. A cable shield termination system as in claim 1, in which the grounding plug further includes a unitary hollow sleeve which is received within the hollow tubular metal shield and electrically and mechanically secured thereto.

6. A cable shield termination system as in claim 1, in which the metal disk is releasably and slidably received within the metal shell open end, and means threadably received onto the metal shell open end to secure the metal disk in conductive contact with the metal shell.

7. A cable shield termination system as in claim 1, in which the spacing between the inwardly facing surface of the metal disk and the contact is so small as to preclude looping of the cable.

8. A cable shield termination system as in claim 1, in which the metal disk is mechanically and electrically secured to the metal shell by welding.

9. A cable shield termination system as in claim 1, in which the metal disk is mechanically and electrically secured to the metal shell by a conductive adhesive.

10. A system for terminating a wire shield, comprising:

a junction box having an open-ended electrically conductive shell through which the wire with a first electrical contact affixed to its end is introduced;

conductive plate means covering the shell open end, said plate means having an opening located to be aligned with a second electrical contact located within the shell and complementary to the first contact;

means for conductively and mechanically securing the plate means to the shell in a gap free manner; and a metal grounding plug for conductive securement to the wire shield and having an internal bore for receiving the wire therethrough, said grounding pug having external dimensions enabling receipt within the plate means opening, said grounding plug having a slotted side wall, first and second radially extending flanges larger than the conductive plate means opening, and the spacing between the first and second flanges being approximately equal to the plate means thickness.

11. A system as in claim 10, in which the grounding plug includes unitary sleeve of such outer dimensions as to enable receipt within the wire shield and about the wire.

* * * * *

UNITED STATES PATENT AND TRADEMARK OFFICE

CERTIFICATE OF CORRECTION

PATENT NO. : 4,820,201

DATED : April 11, 1989

INVENTOR(S) : Michael K. Van Brunt et al

It is certified that error appears in the above-identified patent and that said Letters Patent is hereby corrected as shown below:

On the title page Inventors' should read

--(75) Inventors: Michael K. Van Brunt,
Robert J. Nicoletti,
Jeffrey J. Hager ---.

Signed and Sealed this

Twenty-second Day of May, 1990

*Attest:*

HARRY F. MANBECK, JR.

*Attesting Officer*

*Commissioner of Patents and Trademarks*